US006328204B1

(12) United States Patent
Stacy-Ryan

(10) Patent No.: US 6,328,204 B1
(45) Date of Patent: Dec. 11, 2001

(54) CARTON WITH OVER-FOLDED BOTTOM

(75) Inventor: Russell Stacy-Ryan, Chicago, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/625,937

(22) Filed: Jul. 26, 2000

(51) Int. Cl.[7] ..... B65D 5/08
(52) U.S. Cl. ..... 229/137; 229/184
(58) Field of Search ..... 229/184, 137, 229/125.42, 915.1, 933

(56) References Cited

U.S. PATENT DOCUMENTS

| | | | | |
|---|---|---|---|---|
| 4,192,446 | * | 3/1980 | Naito | 229/184 X |
| 4,540,116 | * | 9/1985 | Shirakawa | 229/184 X |
| 4,667,873 | * | 5/1987 | Yasui et al. | 229/184 X |
| 4,702,410 | * | 10/1987 | Derving | 229/184 |
| 4,801,073 | * | 1/1989 | Farber | 229/184 X |
| 5,056,707 | * | 10/1991 | Larsen | 229/184 X |
| 5,324,250 | | 6/1994 | Janson et al. | |
| 5,474,232 | * | 12/1995 | Ljunstrom et al. | 229/184 X |
| 5,845,840 | | 12/1998 | Johansson et al. | |
| 5,975,414 | | 11/1999 | Stacy-Ryan et al. | |
| 5,988,490 | | 11/1999 | Christensen | |
| 6,019,279 | * | 2/2000 | Tywoniuk | 229/184 X |
| 6,027,015 | | 2/2000 | Christensen | |

FOREIGN PATENT DOCUMENTS 11-70931 * 3/1999 (JP) .....
11-235768 * 8/1999 (JP) .....

* cited by examiner

*Primary Examiner*—Allan N. Shoap
*Assistant Examiner*—Tri M. Mai
(74) *Attorney, Agent, or Firm*—Welsh & Katz, LTD.

(57) ABSTRACT

An over-folded, sealed bottom carton defining an interior storage region includes a plurality of side panels defining upstanding walls. The panels include first, second, third and fourth panels that are separated from adjacent side panels by longitudinal crease lines. A plurality of top panels define a sealed top. A plurality of bottom panels define a sealed bottom. The bottom panels extend from respective, adjacent side panels and separated from their respective side panels by a transverse crease line. Each bottom panel has a length relative to the transverse crease line. The bottom panels are contiguous with adjacent bottom panels and are separated from adjacent panels by the longitudinal crease lines. The bottom panels include rectangular major and minor panels opposing each other and each having a length. The length of the minor panel is less than the length of the major panel. The minor panel has a tab extending from an end thereof and separated from the minor panel by a tab crease line. The tab further includes a raw edge spaced from the crease line. Each of the others of the bottom panels are formed from a plurality of substantially triangular panels and each includes a transverse panel portion extending along an entire side of one of the triangular panels. When the bottom panel is folded to form the sealed bottom, the tab is folded over onto the minor panel at the tab crease line, and each of the transverse panel portions overlies substantially one-half of the tab to isolate the tab raw edge from the carton interior region.

19 Claims, 3 Drawing Sheets

CARTON WITH OVER-FOLDED BOTTOM

FIELD OF THE INVENTION

This invention pertains to a carton bottom panel configuration. More particularly, this invention pertains to a paperboard carton bottom panel configuration that eliminates interior exposed edges and reduces exterior exposed edges.

BACKGROUND OF THE INVENTION

A preferred package for milk and juice is the gable-top package. The gable-top package is typically composed of a paperboard material coated on its interior and exterior surfaces with a thermoplastic material such as polyethylene. A further barrier, such as foil, can be provided on the interior of the package intermediate the paperboard and the layers, for packaging citrus juices and the like.

The package is formed from a blank in a paper converting process. The blank has a plurality of crease lines formed therein for properly folding the blank into the desired package shape. The unconstructed form or blank has a plurality of side panels (typically four) and corresponding top and bottom panels. The side panels define the front, rear and side walls of the package, the top panels form the well-known gable-top and the bottom panels fold and are sealed to one another to form a liquid and gas impervious bottom package seal.

In the converting process, the carton blanks are cut from sheet stock previously coated with the polymer layers. As such, while the face areas of the paperboard are coated, the raw paper edges are uncoated and thus are more susceptible to absorption of moisture. Moisture absorbed into the paperboard material may comprise the integrity of the carton and may result in a reduced shelf life for the packaged product.

The carton bottom is particularly susceptible to moisture absorption. Moisture can be absorbed into raw edges from both the interior and the exterior of the package. To this end, various configurations and devices have been developed in an effort to reduce the opportunity for raw edge absorption at the carton bottom. Configurations are disclosed in Christensen, U.S. Pat. No. 6,027,015 and U.S. Pat. No. 5,988,490 and Johansson et al., U.S. Pat. No. 5,845,840 which patents are commonly assigned herewith and are incorporated herein by reference. The aforementioned patents work well in preventing raw edge liquid absorption from an exterior source, however, they do not address the absorption of liquid from an carton interior source.

Accordingly, there exists a need for a carton and a carton blank configuration that eliminates the exposure of the raw edges to moisture from both interior as well exterior conditions. Desirably, such a configuration can be accommodated on known form, fill and seal packaging machines with little to no modification to existing components.

SUMMARY OF THE INVENTION

A carton for storing a product, such as milk, juice and the like, defines a sealed interior storage region. The carton includes a plurality of side panels that define upstanding walls. The panels include first, second, third and fourth panels separated from adjacent side panels by longitudinal crease lines. A plurality of top panels define a sealed top.

A plurality of bottom panels define an over-folded, sealed bottom. The bottom panels extend from respective, adjacent side panels and are separated from their respective side panels by a transverse crease line. Each bottom panel has a length relative to the transverse crease line. The bottom panels are contiguous with adjacent bottom panels and are separated from adjacent bottom panels by the longitudinal crease lines.

The bottom panels include a rectangular major panel having a length, and a rectangular minor panel having a length. The length of the minor panel is less than length of the major panel. Preferably, the major bottom panel is adjacent the first side panel and the minor bottom panel is adjacent the third side panel, opposing the major bottom panel.

The minor panel has a tab extending from an end thereof that is separated from the minor panel by a tab crease line. The tab further includes a raw edge spaced from the crease line.

Each of the others of the bottom panels is formed from a plurality of substantially triangular panels. Each of the others of the bottom panels also includes a transverse panel portion extending along an entire side of one of the triangular panels. Preferably, each transverse panel portion is separated from its triangular panel by a transverse crease line, and is separated from another of its bottom panels by a short longitudinal crease line.

When the bottom panel is folded to form the sealed bottom, the tab is folded over onto the minor panel at and along the tab crease line, and each of the transverse panel portions overlies substantially one-half of the tab to isolate and space the tab raw edge from the carton interior region.

In a present embodiment, the major bottom panel and the transverse panel portions include angled corners to minimize the exposure of raw edges to external environmental sources. Preferably, the major and minor bottom panels fully cover the others of the bottom panels, and the major bottom panel covers at least a portion of the minor bottom panel when the over-folded bottom is fully folded and sealed.

A blank for the over-folded bottom carton includes a first side panel, a second side panel, a third side panel and a fourth side panel. The side panels are separated from adjacent side panels by respective longitudinal crease lines.

The blank includes a plurality of top panels. Each top panel is contiguous with adjacent ones of the other top panels, and contiguous with a respective side panel. The top panels are separated from the side panels by a first transverse crease line and are separated from adjacent top panels by the longitudinal crease lines.

A plurality of bottom panels extend and are separated from respective, adjacent side panels by a second transverse crease line. Each bottom panel has a relative to the transverse crease line. The bottom panels are contiguous with adjacent bottom panels and are separated from adjacent bottom panels by the longitudinal crease lines. The bottom panels include a rectangular major panel having a length, and a rectangular minor panel having a length. The length of the minor panel is less than the length of the major panel.

In a preferred embodiment, the major panel is adjacent the first side panel and the minor bottom panel is adjacent the third side panel, opposing the major bottom panel. The minor panel includes a tab extending from an end thereof. The tab has a width and is separated from the minor panel by a tab crease line. The tab further includes a raw edge spaced from the crease line.

Each of the others of the bottom panels is formed from a plurality of substantially triangular panels. Each also includes a transverse panel portion extending along an entire side of one of the triangular panels. The transverse portions and the tab define gaps therebetween. The gaps each have a width that is about equal to the width of the tab. Preferably, the transverse panel portions are each separated from their respective triangular panels by a transverse crease line and are separated from another of their respective bottom panels by a short longitudinal crease line.

In a present embodiment, the major bottom panel includes angled corners at junctures with each of the others of the bottom panels and the transverse panel portions each include an angled corner. Preferably, the major bottom panel has a length greater than the length of the others of the bottom panels, which each have a length that is greater than the length of the minor bottom panel.

Other features and advantages of the present invention will be apparent from the following detailed description, the accompanying drawings and the appended claims.

DETAILED DESCRIPTION OF THE PREFERRED EMBODIMENTS

Figure 2:
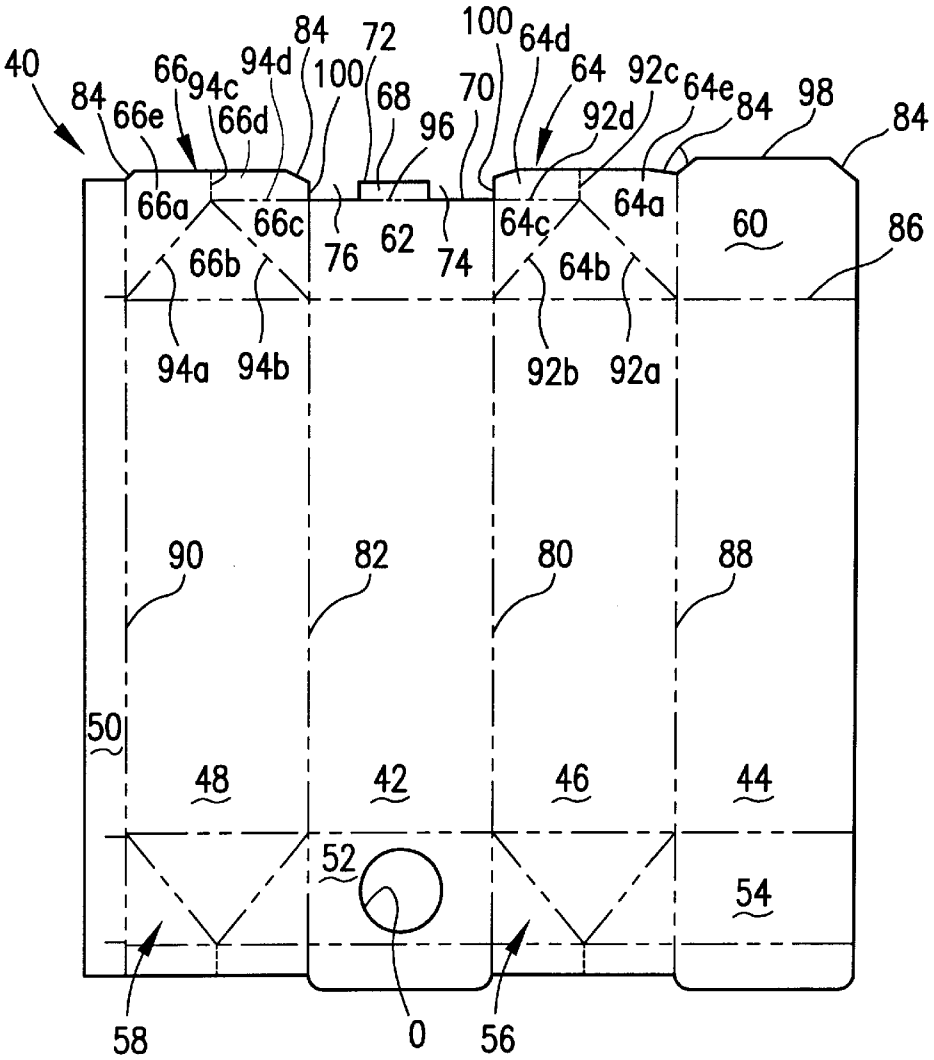
FIG. 2 is an exemplary blank for forming the over-folded bottom carton of FIG. 1, the blank being shown inverted (i.e., upside-down) for ease of discussion of the carton bottom panels.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 1:
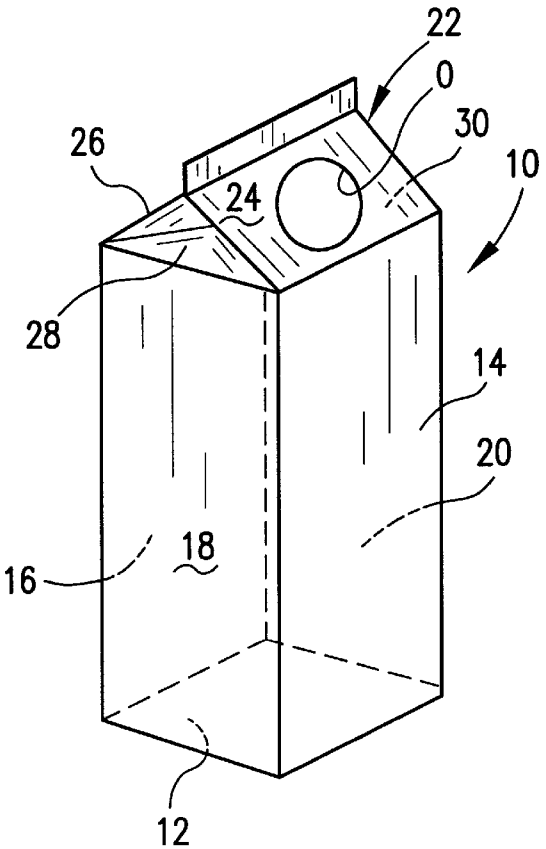
FIG. 1 is a perspective view of a gable-top carton having an over-folded bottom embodying the principles of the present invention.

Referring now to the figures and in particular to FIG. 1, there is shown a conventional, well-known gable-top carton 10 having a novel over-folded bottom 12 in accordance with the principles of the present invention. The carton 10, as constructed, includes front and rear walls 14, 16, and a pair of opposing side walls 18, 20. The carton further includes a gable-top 22 that is configured from a plurality of gable walls. The gable walls include front and rear slanted walls 24, 26 and inwardly oriented gable walls 28, 30. The carton 10 bottom wall 12 is formed from a plurality of panels which, as will be more fully discussed below, are sealed to one another to provide the sealed package bottom. The carton 10 can be formed with, for example, an opening O on one of the front and rear gable top panels 24, 26, to accommodate a spout or like dispensing device.

Referring now to FIG. 2, there is shown a carton blank 40 for the overfolded bottom carton 10. Panels 42, 44, 46 and 48 correspond to the front, rear and side walls (14–20) of the carton 10. These are commonly referred to as the third, first, second, and fourth panels, respectively. A fifth panel 50 extends from the fourth panel 48 for sealing to the first panel 44 to form the tubular carton form, as will be recognized by those skilled in the art. Panels 52, 54 correspond to the front and rear slanted gable walls 24, 26, respectively The inwardly oriented gable walls 28 and 30 are represented by panels 56 and 58, generally.

The carton bottom 12 is configured from panels 60, 62, 64 and 66. The bottom panels are flat, planar panels and include major panel 60 and minor panel 62. The side panels 64, 66 are formed from generally triangular panel sections 64*a,b,c* and 66*a,b,c*. Although panels 64*a* and 66*a* each include a "projecting" portion (indicated at 64*e* and 66*e*, respectively), for purposes of the present description and the claims that follow, these panels 64*a* and 66*a* will be described generally as triangular.

The minor bottom panel 62 includes a tab 68 that extends from about an upper most edge 70 of the panel 62. As will be discussed below, this tab 68 projects the raw edge (indicated at 72) location away from the interior of the carton 10 when the bottom panels 60–66 are in-folded and sealed to form the constructed carton bottom 12. For purposes of the present description and the claims that follow, reference to the "other" or "others" of the panels refers generally to panels 64 and 66.

Bottom panels 64 and 66 include inwardly extending transverse portions 64*d* and 66*d* that define gaps 74, 76 between the respective portion ends and tab 68. The transverse portions 64*d*, 66*d* extend (from the projecting portions 64*e* and 66*e*) fully to the outer edges of the panels 64, 66, rather than forming only a partial width portion. That is, unlike known blanks, in the present blank 40, the transverse portions 64*d*, 66*d* extend to longitudinal crease lines 80, 82, respectively. Bottom panels 60, 64 and 66 have angled upper corners, as indicated at 84, that are provided to reduce raw edge exterior exposure and to improve the integrity and aesthetics when the carton 10 is fully constructed.

As will be recognized by those skilled in the art, the bottom panels 60–66 are separated from their respective side panels 42–50 by transverse crease 86. The bottom panels 60–66 are separated from their adjacent panels by longitudinal crease lines 80, 82, 88 and 90, which crease lines also separate the various side panels 42–50 from their adjacent panels. Crease lines 92*a–d* and 94*a–d* separate the various panels 64*a–d* and 66*a–d* from one another on bottom panels 64 and 66, respectively. A further transverse crease line 96 separates tab 68 from its bottom panel 62. Crease line 96 is spaced from the raw edge 72. Longitudinal creases 92*c* and 94*c* extend from the apex of triangular panels 64*b* and 66*b* and, in conjunction with transverse creases 92*d* and 94*d*, separate the transverse panel portions 64*d* and 66*d* from their respective triangular panels 64*a,c* and 66*a,c*.

Figure 3A:
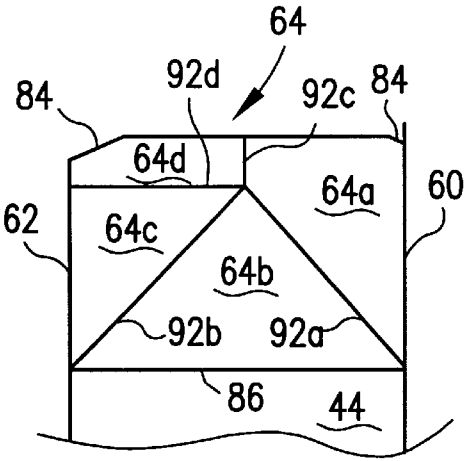
FIG. 3*a* is a side view of the over-folded carton bottom, the carton being shown inverted (i.e., upside down) with the bottom flaps extending straight from the side panels.
Figure 3B:
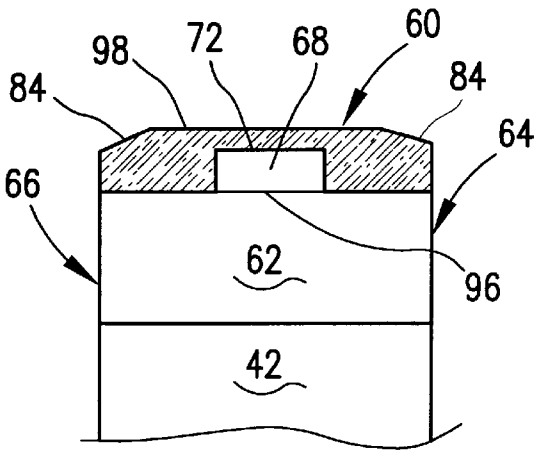
FIG. 3*b* is a front view of the carton orientation of FIG. 3*a*.
Figure 7:
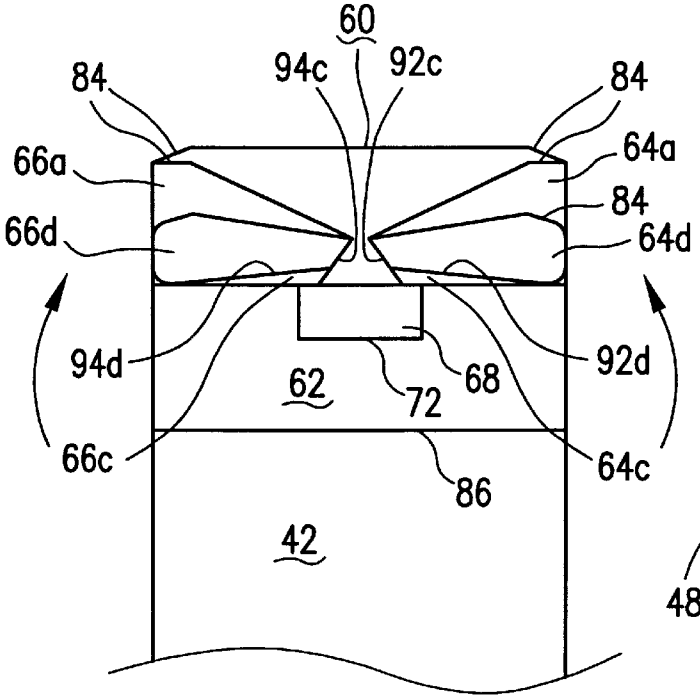
FIG. 7 is a front view similar to FIG. 4*b*, with the bottom triangular panels urged inward and the major and minor bottom panels being folded inward to form the folded bottom, and with the minor bottom panel being shown in the foreground of the figure.

Referring now to FIGS. 3*a* and 3*b*, the carton bottom is shown with all of the bottom panels 60–66 extending upwardly from their respective walls. In these figures, as well as FIG. 7, the surfaces that define the interior region or space of the carton 10 are shown shaded.

Figure 4A:
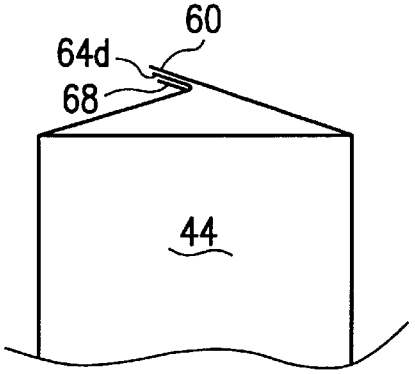
FIG. 4*a* is a side view similar to FIG. 3*a*, with the bottom flaps being urged into the folded position.

As the carton bottom 12 is folded, side panels 64 and 66 are urged inward, as seen in FIGS. 4*a,b* and 7. The central triangular panels 64*b*, 66*b* move into the carton 10 so that they lie flat to form a portion of the flat bottom. Panels 64*a* and 66*a* also move inwardly so they lie against major panel 60 and so that panels 64*c* and 66*c* lie against minor panel 62. At this point, the transverse portions 64*d* and 66*d* rest against the projecting portions (i.e., uppermost portions) 64*e* and 66*e* of panels 64*a* and 66*a*.

Figure 5:
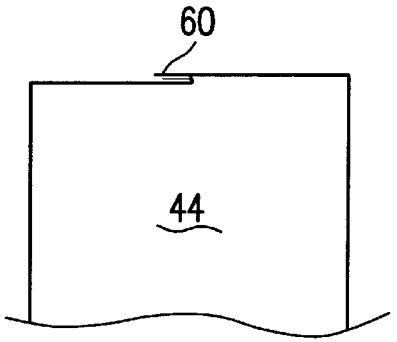
FIG. 5 is a side view of the carton with the bottom panels fully folded.
Figure 6:
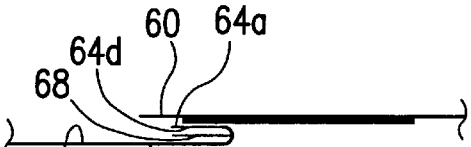
FIG. 6 is a partial, exaggerated view of the bottom panels and the relationship between the panels when the carton bottom is fully folded.
Figure 8:
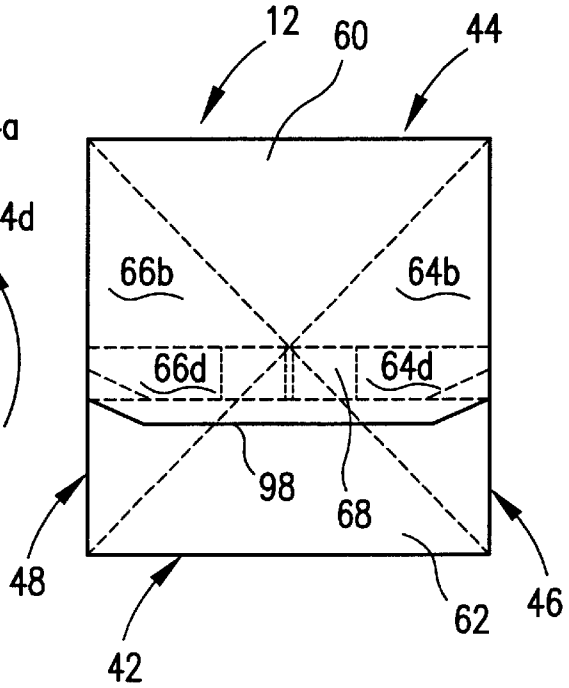
FIG. 8 is a bottom view of the folded and sealed bottom wall of the carton, the triangular panels and a portion of the minor panel, including the tab being shown in phantom lines as they are positioned under the major bottom panel.

Further folding urges tab 68 to fold onto itself, and brings major panel 60 to rest over all of the panels, as seen in FIGS. 5, 6 and 8. When folded in this manner, the only external bottom raw edge is edge 98 of major panel 60. However, as discussed in the aforementioned patents to Christensen, this edge 98 can be elevated above (i.e., recessed into) the carton bottom 12. Transverse portion edges, as indicated at 100 are also externally exposed, however, these are sealed below major panel 60 (i.e., between major panel 60 and panels 64*a* and 66*a*), and as such are less susceptible to exposure to external liquids.

Figure 9:
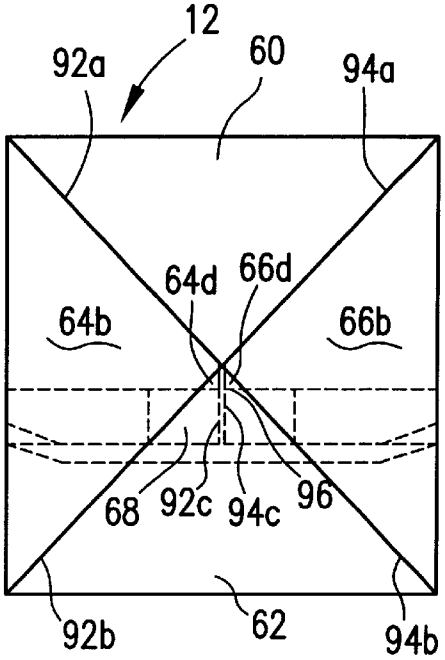
FIG. 9 is a view of the inside of the carton immediately prior to full folding of the bottom panels.

Referring now to FIG. 9, there is shown an internal view of the carton 10 with the panels 60–66 fully folded. The external panel arrangement is shown in phantom while the solid lines represent the panels (portions of panels 60, 62, 64*b* and 66*b*) that are visible from the carton interior. The tab 68 is positioned at the juncture of transverse portions 64*d* and 66*d* where they meet one another (at crease lines 92*c* and 94*c*) when the panels 64 and 66 are infolded, and are folded over the minor bottom panel 62. Because the tab 68 is folded over onto itself, it provides an interior surface portion of the carton 10 (e.g., a foil lined area) that is positioned at the juncture of the transverse portion 64*d* and 66*d*. In addition, the extended width of the transverse portions 64*d* and 66*d* (which essentially abut one another when fully infolded) in conjunction with the width of the tab 68, provides greater assurance that only coated paperboard areas of the carton (rather than raw edges) contact the product in the package.

Figure 4B:
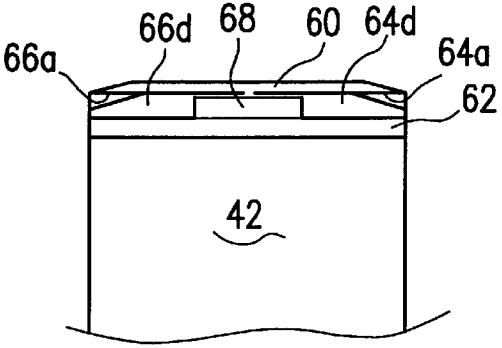
FIG. 4*b* is a front view similar to FIG. 3*b*, with the bottom panel flaps in the position as seen in FIG. 4*a;*

Referring now to FIGS. 4–6, there is shown the package bottom 12 as it is being folded (FIGS. 4*a–b*), and fully folded (FIG. 5, with an enlarged, partial view shown in FIG. 6). As it is folded, the tab 68 folds over onto itself, thus exposing the packaged product to only the carton interior surface. The raw edge 72 of the tab 68 projects or is displaced away from the juncture of the side panels 64, 66. The transverse portions 64*d* and 66*d* fold over tab 68, and panels 64*a* and 66*a* fold over panels 64*c* and 66*c* (with the projecting portions 64*e* and 66*e* folding over transverse portions 64*d* and 66*d*).

As can be seen from FIG. 6, the ends or terminal portions of each the tab 68, transverse portions 64*d* and 66*d*, and panels 64*a* and 66*a* (at portions 64*e* and 66*e*), all about align with each other when fully folded over. Major panel 60, which is folded over all of the other panels, extends beyond the terminal ends of the other panels, and in the final, constructed form, is sealed onto the minor bottom panel 62 by, for example heating and fusing (or melting) the polyethylene coating onto other polyethylene coated surfaces.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A carton having an over-folded, sealed bottom, defining an interior storage region for storing a product, comprising;

a plurality of side panels defining upstanding walls, the panels including first, second, third and fourth panels separated from adjacent side panels by longitudinal crease lines;

a plurality of top panels defining a sealed top; and a plurality of bottom panels defining the over-folded, sealed bottom, the bottom panels extending from respective, adjacent side panels and separated from their respective side panels by a transverse crease line, each bottom panel having a length relative to the transverse crease line, each bottom panel being contiguous with adjacent bottom panels, the bottom panels separated from adjacent bottom panels by the longitudinal crease lines, the bottom panels including a rectangular major panel having a length, and a rectangular minor panel having a length that is less than the length of the major panel, the minor panel having a tab extending from an end thereof, the tab being separated from the minor panel by a tab crease line, the tab having a width less than a width of the minor panel, the tab further including a raw edge spaced from the tab crease line, each of the others of the bottom panels being formed from a plurality of substantially triangular panels, each of the other of the bottom panels having a transverse panel portion extending along an entire side of one of the triangular panels, the transverse panel portions extending fully to their respective longitudinal crease lines, the transverse panel portions being spaced from the tab, wherein when the bottom panel is folded to form the sealed bottom, the tab is folded over onto the minor panel at the tab crease line, and each of the transverse panel portions overlies substantially one-half of the tab to isolate the tab raw edge from the carton interior region.

2. The over-folded, sealed bottom carton in accordance with claim 1 wherein the transverse panel portion is separated from its triangular panel by a transverse crease line.

3. The over-folded, sealed bottom carton in accordance with claim 1 wherein the transverse panel portion is separated from another of the bottom panels by a short longitudinal crease line.

4. The over-folded, sealed bottom carton in accordance with claim 1 wherein the major bottom panel includes angled corners at junctures with each of the others of the bottom panels.

5. The over-folded, sealed bottom carton in accordance with claim 1 wherein the transverse panel portions each include an angled corner.

6. The over-folded, sealed bottom carton in accordance with claim 1 wherein when the major bottom panel fully covers the others of the bottom panels and covers at least a portion of the minor bottom panel.

7. The over-folded, sealed bottom carton in accordance with claim 1 wherein the major panel is adjacent the first side panel.

8. The over-folded, sealed bottom carton in accordance with claim 1 wherein the minor panel is adjacent the third side panel.

9. The over-folded, sealed bottom carton in accordance with claim 8 wherein the major panel is adjacent the first side panel.

10. A blank for an over-folded, sealed bottom carton comprising;

a first side panel, a second side panel, a third side panel and a fourth side panel, the side panels being separated from adjacent side panels by respective longitudinal crease lines;

a plurality of top panels, each of the top panels being contiguous with adjacent one of the other top panels, and contiguous with a respective side panel, the top panels being separated from the side panels by a first transverse crease line and being separated from adjacent top panels by the longitudinal crease lines; and a plurality of bottom panels extending from and separated from respective, adjacent side panels by a second transverse crease line, each bottom panel having a length relative to the transverse crease line, each bottom panel being contiguous with adjacent bottom panels and separated from adjacent bottom panels by the longitudinal crease lines, the bottom panels including a rectangular major panel having a length, and a rectangular minor panel having a length less than the length of the major panel, the minor panel having a tab extending from an end thereof, the tab having a width that is less than a width of the minor panel, the tab being separated from the minor panel by a tab crease line, the tab further including a raw edge spaced from the tab crease line, each of the others of the bottom panels being formed from a plurality of substantially triangular panels, each of the other of the bottom panels having a transverse panel portion extending along an entire side of one of the triangular panels and extending to their respective longitudinal crease lines, the transverse panel portions being spaced from the tab, wherein the transverse portions and the tab define gaps therebetween, the gaps each having width, and wherein the width of each of the gaps is about equal to the width of the tab.

11. The blank in accordance with claim 10 wherein the transverse panel portion is separated from its triangular panel by a transverse crease line.

12. The blank in accordance with claim 10 wherein the transverse panel portion is separated from another of the bottom panels by a short longitudinal crease line.

13. The blank in accordance with claim 10 wherein the major bottom panel includes angled corners at junctures with each of the others of the bottom panels.

14. The blank in accordance with claim 10 wherein the transverse panel portions each include an angled corner.

15. The blank in accordance with claim 10 wherein the major panel is adjacent the first side panel.

16. The blank in accordance with claim 10 wherein the minor panel is adjacent the third side panel.

17. The blank in accordance with claim 16 wherein the major panel is adjacent the first side panel.

18. The blank in accordance with claim 10 wherein the major bottom panel has a length greater than the length of the minor bottom panel and greater than the length of the other of the bottom panels.

19. The blank in accordance with claim 18 wherein the length of the other of the bottom panels is greater than the length of the minor bottom panel.

* * * * *